US008516780B2

(12) United States Patent
Derks

(10) Patent No.: US 8,516,780 B2
(45) Date of Patent: Aug. 27, 2013

(54) METHOD AND DEVICE FOR STRAPPING ONE OR MORE PACKETS WITH A BAND WITH LABEL MEANS

(75) Inventor: Wilhelmus Johannes Maria Derks, Grave (NL)

(73) Assignee: Endra B.V., Heesch (NL)

( * ) Notice: Subject to any disclaimer, the term of this patent is extended or adjusted under 35 U.S.C. 154(b) by 1523 days.

(21) Appl. No.: 10/490,180

(22) PCT Filed: Sep. 20, 2002

(86) PCT No.: PCT/NL02/00605

§ 371 (c)(1),
(2), (4) Date: Sep. 28, 2004

(87) PCT Pub. No.: WO03/026968

PCT Pub. Date: Apr. 3, 2003

(65) Prior Publication Data

US 2005/0028485 A1 Feb. 10, 2005

(30) Foreign Application Priority Data

Sep. 20, 2001 (NL) ..... 1019001

(51) Int. Cl.
*B65B 13/02* (2006.01)

(52) U.S. Cl.
USPC ..... 53/399; 53/228; 53/586; 100/11; 100/18; 100/29; 100/33 PB

(58) Field of Classification Search
USPC ..... 53/228, 399, 586, 415, 411, 135.1, 53/135.2, 135.3; 100/7, 11, 17, 18, 19 R, 100/29, 32, 33 R, 33 PB
See application file for complete search history.

(56) References Cited

U.S. PATENT DOCUMENTS

| | | | | | |
|---|---|---|---|---|---|
| 3,331,312 | A | * | 7/1967 | Leslie et al. | 100/28 |
| 3,783,575 | A | | 1/1974 | Angenendt | |
| 3,996,719 | A | * | 12/1976 | Dabrowski et al. | 53/399 |
| 3,997,384 | A | | 12/1976 | Kuring | |
| 4,540,619 | A | * | 9/1985 | Watanabe | 428/192 |
| 4,610,124 | A | * | 9/1986 | Watanabe et al. | 53/399 |
| 4,628,668 | A | * | 12/1986 | Wildmoser | 53/399 |
| 4,665,679 | A | * | 5/1987 | Watanabe | 53/131.5 |
| 4,782,648 | A | * | 11/1988 | Van Ottele | 53/553 |
| 5,551,212 | A | * | 9/1996 | Odenthal | 53/397 |
| 6,021,711 | A | * | 2/2000 | van Ottele | 100/11 |
| 6,085,487 | A | * | 7/2000 | De Vlaam | 53/176 |

FOREIGN PATENT DOCUMENTS

| | | |
|---|---|---|
| EP | 0 890 510 | 1/1999 |
| GB | 2 215 300 | 9/1989 |

* cited by examiner

*Primary Examiner* — Thanh Truong
(74) *Attorney, Agent, or Firm* — The Webb Law Firm

(57) ABSTRACT

A method and device for strapping one or more packets with a band, which device substantially comprises a frame, a lying conveyor belt supported by the frame for moving forward the packets, a pair of band clamping and guiding jaws movable toward and away from each other transversely of the conveyor belt, a supply reel associated with a jaw and guide members for the strapping band in addition to welding means co-acting with the jaws for welding together the band portions supplied by the pair of jaws, wherein means for arranging one or more label means at a time on the band are placed along the guide path of this band.

4 Claims, 4 Drawing Sheets

METHOD AND DEVICE FOR STRAPPING ONE OR MORE PACKETS WITH A BAND WITH LABEL MEANS

BACKGROUND OF THE INVENTION

The invention relates to a device for strapping one or more packets with a band, which device substantially comprises a frame, a lying conveyor belt supported by the frame for moving forward the packets, a pair of band clamping and guiding jaws movable toward and away from each other transversely of the conveyor belt, a supply reel associated with a jaw and guide members for the strapping band in addition to welding means co-acting with the jaws for welding together the band portions supplied by the pair of jaws.

Such a device is known from EP 0 890 510 in the name of applicant, wherein a strapping device is generally described. A number of packets is herein formed into a group, which group runs up against a strapping band which is then welded by welding heads which simultaneously closes the band for the following group of packets.

SUMMARY OF THE INVENTION

The present invention has for its object to provide such a band with a label means so that the strapped packets acquire an identification so that they can be traced, named or provided with a destination address.

The device according to the invention is distinguished in that means for arranging one or more label means at a time on the band are placed along the guide path of this band.

Because the means are placed directly along the guide path of the band, arranging of label means round the band also forms an indication for the group of packets. It is possible to dispense with labelling of the packets themselves.

In a further development of the invention, further means are arranged for moving the band reciprocally to enable positioning of the band in front of the arranging means.

The band is in any case always placed with a new weld roughly in the middle of the conveyor belt for the packets, this position not corresponding wholly with the position of arrangement of the label means. By setting the band beforehand into a reciprocating longitudinal movement the position on the band where the label means must be arranged can be placed precisely in front of the arranging means and subsequently moved back again to the starting position, this such that particularly the arranging of two label means on either side of for instance a corner edge of the group of packets is possible.

If the strapping device according to the invention is already provided with a number of guide rollers over which the band is guided in order to keep it taut during the strapping, the moving means are preferably integrated into these guide rollers, of which a pair of in each case two rollers can be arranged for movement toward and away from each other, so that the band can be moved in simple manner in longitudinal direction relative to the centre line of the conveyor belt for the packets.

The invention finally relates to a method for strapping one or more packets with a band, which packets are ordered into a group, transported in a determined direction, a strapping band is tensioned transversely of this transporting direction, the packets are pressed against this band whereafter the band can be nestled around the group of packets, which band is welded together by means of heat, this method being further distinguished in that a label means is arranged beforehand on the band. According to a further method the band can, prior to contact with the group of packets, first be moved in longitudinal direction thereof in order to allow advance placing of the labelling position at a labelling station.

BRIEF DESCRIPTION OF THE DRAWINGS

The invention is further elucidated in the figure description hereinbelow of an embodiment which is illustrated in the annexed drawings.

In the drawing.

DETAILED DESCRIPTION OF THE PREFERRED EMBODIMENTS

Figure 1:
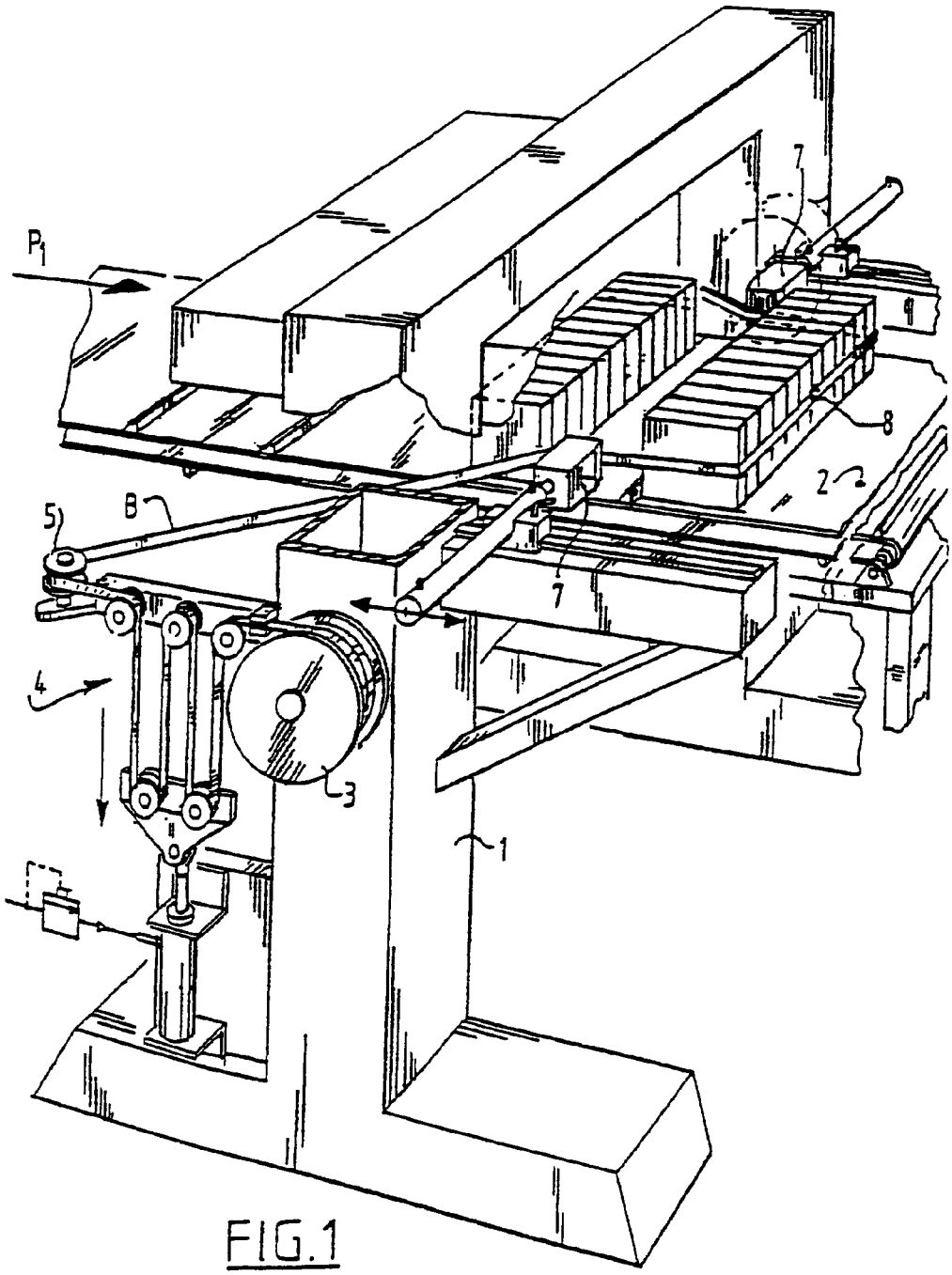
FIG.1 PRIOR ART
FIG. 1 shows a perspective schematic view of a prior art strapping device.

Designated with the numeral 1 in FIG. 1 is a frame of the prior art device which can be constructed in random manner. The frame is portal-like such that a conveyor 2 can be arranged under the portal for transporting packets P in the direction of arrow P1. The packets are combined into a series of packets around which a band B must be strapped. To this end the band can be unwound from a supply 3 and is guided to welding-clamping jaws 6 via a braking mechanism 4, which is assumed known in the professional field and requires no further explanation, and via reversing pulleys 5. It is stated for the sake of clarity that supply roll 3 with the band guide systems 4, 5 is likewise arranged on the other side of the device. Both ends of the band on the left-hand respectively right-hand side of conveyor 2 are welded to each other at 8, wherein clamping jaws 7 are moved toward each other behind the combined packet P by means of a cylinder 9. The band is herein nestled against the rear side P and held under tension by the braking means 4.

Figure 2:
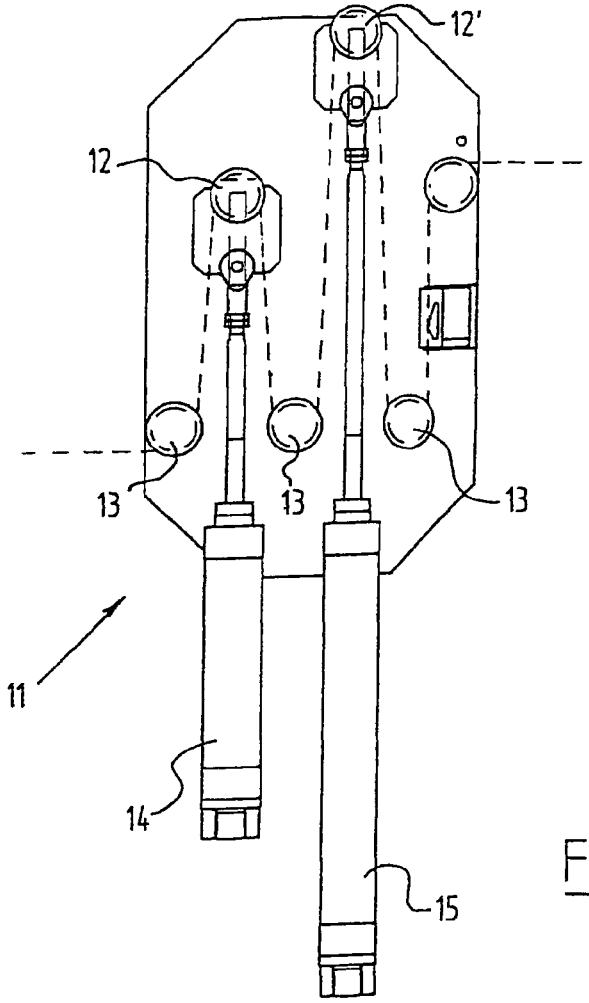
FIG. 2 shows a schematic front view of a displacing-positioning unit for displacing the band in longitudinal direction thereof.

In accordance with the characteristic of the invention a supply device for label means, generally designated with reference numeral 10, is arranged adjacently of the frame, see FIG. 3. It is possible with such a supply device to arrange a label means E onto strapping band B, see FIG. 3*b*, which is sufficient in the very simplest form to place a label means around packet P. In accordance with a further characteristic of the invention, it is however possible to displace strapping band B in longitudinal direction thereof by means of a positioning unit, which is shown in detail in FIG. 2. Positioning unit 11 lies on either side of frame 1 and is in fact integral with the band guiding system 4, 5 as shown in FIG. 1.

Reversing rollers 12 and 12' are each supported by a hydraulic or pneumatic cylinder such that the distance between the fixed reversing rollers 13 and movable reversing rollers 12 can be varied. A similar positioning unit 11 is placed on the other side of frame 1, whereafter cylinders 14, 15 are controlled such that the band can displace in a reciprocating longitudinal direction of itself as represented by arrow B1, so that label means E are arranged precisely at a determined position on the band.

Figure 3A:
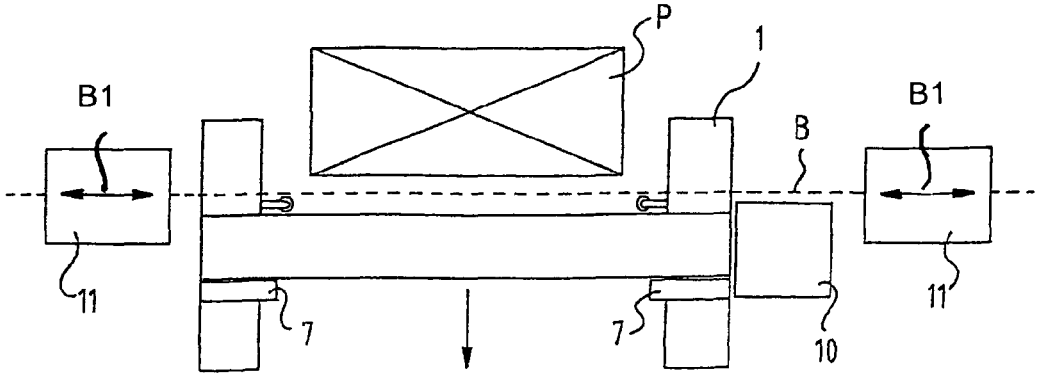
FIGS. 3*a, b, c, d*, e, f, g show in each case a schematic top view of the device of FIG. 1, provided here however with means for arranging a label means and for positioning the band, at different stages of the strapping method according to the invention.
Figure 3B:
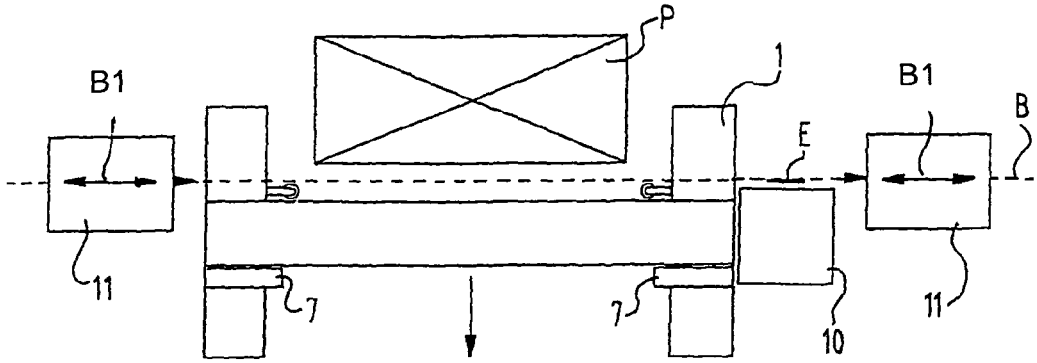
Figure 3C:
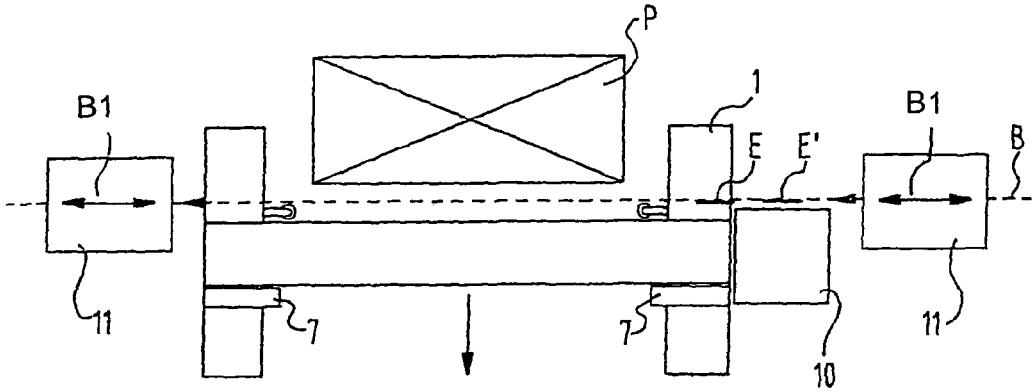
Figure 3D:
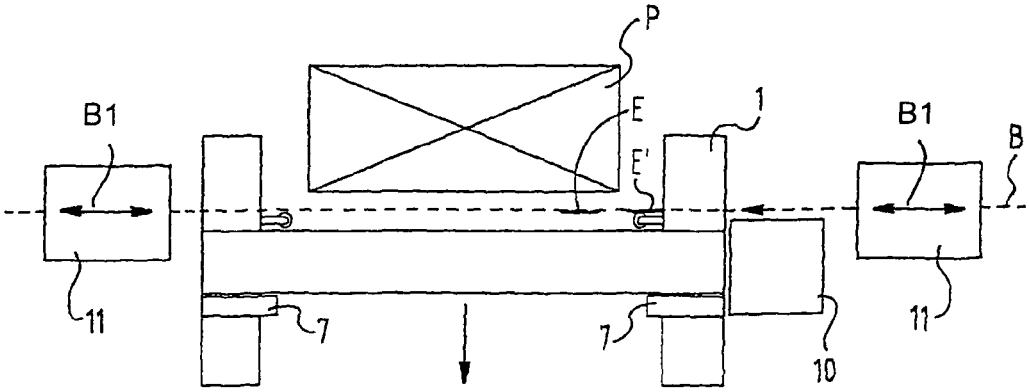
Figure 3E:
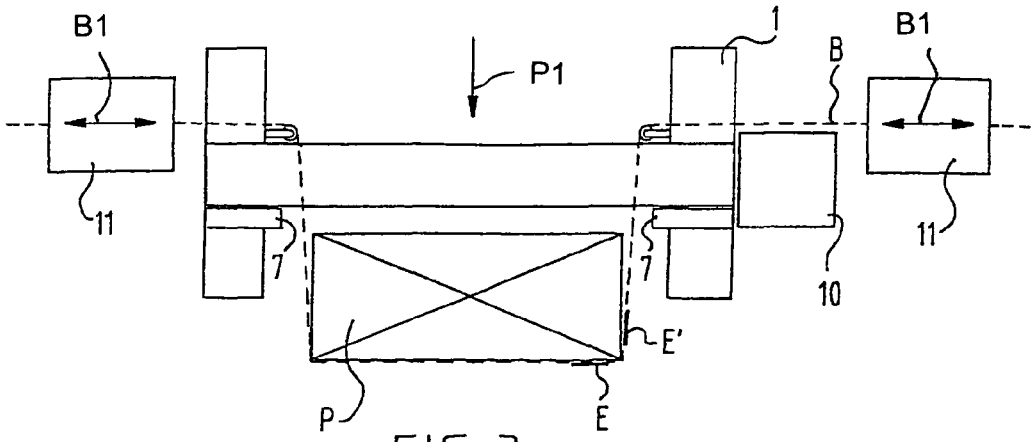
Figure 3F:
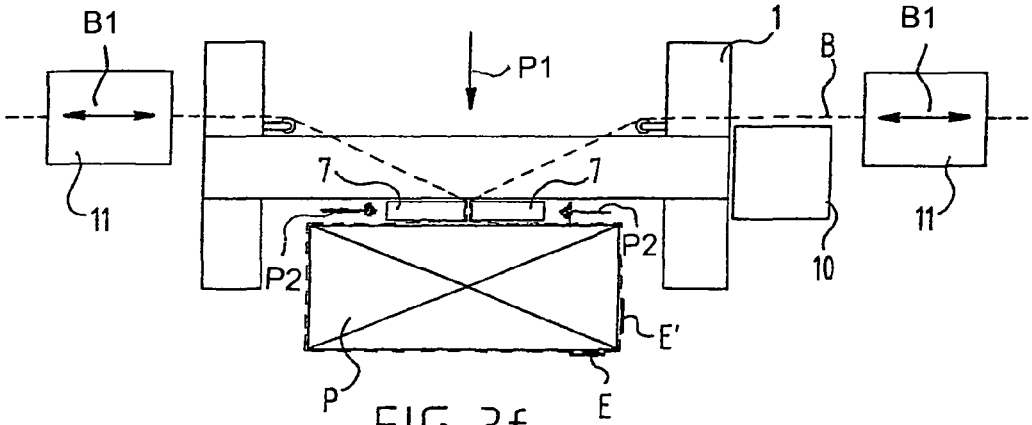
Figure 3G:
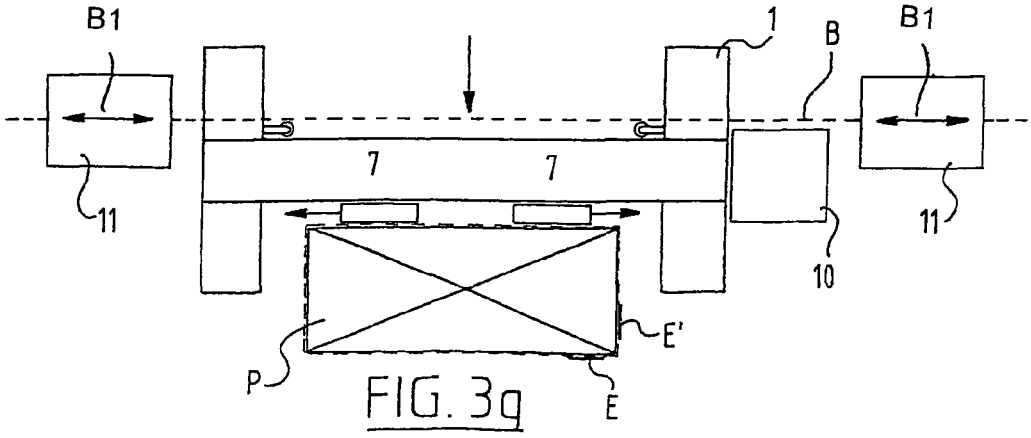

Referring to FIG. 3*c*, a second label means E' is placed adjacently of the previously arranged label means E, whereafter the band is moved to the left, see FIG. 3*d*, such that the corner of the packet eventually comes to lie between the two label means E, E', see FIG. 3*e*, after the conveyor belt is set into operation and the packet runs up against the strapping band in the direction of arrow P1. Once the packet has run through a sufficient distance beyond the welding heads, these welding heads 7 can be moved toward each other, see arrows P2 in FIG. 3*f*, whereafter the weld can be realized and the band is welded together again to form a new strapping band B, see FIG. 3*g*.

The packet can then be discharged with the label means E close to the corner edge.

The invention is not limited to the above described embodiment. More than one label means supply device 10 can thus be placed, for instance on the other side of frame 1. The label means supply device is of random nature and can be suitable for arranging adhesive label means as well as wrapping label means, wherein the label means is folded wholly round the band.

The described positioning unit can also be embodied in a manner other than the hydraulic-pneumatic guide roller displacements, and can be embodied with electric stepping motors which not only hold the band under tension but can also displace in longitudinal direction.

The invention claimed is:

1. A device for strapping one or more packets with a band, comprising: a frame, a lying conveyor belt supported by the frame for moving forward the packets, a pair of band clamping and guiding jaws movable toward and away from each other transversely of the conveyor belt, a supply reel associated with a jaw and guide members for the strapping band in addition to welding means co-acting with the jaws for welding together the band portions supplied by the pair of jaws in a position substantially near the middle of the conveyor belt, a means placed along the guide path of the band for arranging one or more label means at a time on the band, and a means arranged for moving the band reciprocally to enable positioning of the band in front of the means for arranging one or more label means at a time on the band in a position offset from the position wherein the band is placed with the weld substantially near the middle of the conveyor belt.

2. The device as claimed in claim 1, wherein the band is guided along a set of reversing rollers, and wherein the reversing rollers can be moved away from and toward each other to allow displacing and positioning of the band in a longitudinal direction.

3. A method for strapping one or more packets with a band and arranging label means on said band, which packets are ordered into a group, transported on a conveyor belt in a determined direction, a strapping band is tensioned transversely of this transporting direction wherein the band is placed with a new weld in a position substantially near the middle of the conveyor belt, this position offset from the position of arrangement of the label means, whereupon the band is moved reciprocally to enable positioning of the band, wherein first label means are arranged on the band and next the packets are pressed against this band, whereafter the band can be nestled around the group of packets, which band is welded together by means of heat, wherein label means are arranged beforehand on the band, and wherein label means are arranged on the band before the packets are pressed against the band.

4. The method as claimed in claim 3, wherein prior to contact with the group of packets, the band is first moved in a longitudinal direction thereof in order to allow advance placing of the labelling position at a labelling station.

* * * * *